United States Patent [19]

Fraser

[11] Patent Number: 4,908,994

[45] Date of Patent: Mar. 20, 1990

[54] DIAMOND SKATE SHARPENER

[76] Inventor: Robert A. Fraser, 3 Evans St., Saugus, Mass. 01906

[21] Appl. No.: 55,940

[22] Filed: May 7, 1987

[51] Int. Cl.[4] ..... B23F 21/03

[52] U.S. Cl. ..... 51/208; 51/214

[58] Field of Search ..... 51/204, 205 R, 205 WG, 51/208, 211 R, 211 H, 214, 206, 206.4

[56] References Cited

U.S. PATENT DOCUMENTS

| | | | |
|---|---|---|---|
| 555,974 | 3/1896 | Roberts et al. . | |
| 641,752 | 1/1900 | Stepzinski . | |
| 1,273,624 | 7/1918 | Krollius | 51/208 |
| 1,335,813 | 4/1920 | Berghman | 51/205 UG |
| 1,468,347 | 9/1923 | Graves . | |
| 2,053,359 | 9/1936 | Wright | 51/205 WG |
| 2,118,617 | 5/1938 | Nicolet | 51/205 WG |
| 2,154,744 | 4/1939 | Hammond . | |
| 2,461,690 | 2/1949 | Leong | 51/208 |
| 2,542,281 | 2/1951 | Lefteruk . | |

*Primary Examiner*—Frederick R. Schmidt
*Assistant Examiner*—Blynn Shideler
*Attorney, Agent, or Firm*—Fleit, Jacobson, Cohn, Price, Holman & Stern

[57] ABSTRACT

A body assembly is provided defining a wide shallow slot opening outwardly of one side of the body assembly and endwise outwardly of the opposite ends thereof. The body assembly further defines a recess depressed below and opening upwardly into the bottom of the slot intermediate the opposite ends thereof and the body assembly shiftably mounts a support for movement between first and second positions relative to the body assembly in which first and second course and fine abrasive elements carried by the support face upwardly into the slot and project slightly above the bottom of the slot. A pair of opposite side elongated guide members are mounted in the slot for movement toward and away from each other and include opposing guide surfaces for guidingly engaging the opposite sides of a skate blade centered in the slot, the guide members being yieldingly biased toward each other and incorporating guide surfaces comprising opposing peripheral portions of longitudinally spaced rollers journalled from each of the guide members.

8 Claims, 1 Drawing Sheet

DIAMOND SKATE SHARPENER

BACKGROUND OF THE INVENTION

1. Field of the Invention

This invention relates to a manual skate sharpener and more specifically to a hand-held skate sharpener.

The sharpener includes selectively usable course and fine abrasive elements which may be successively shifted into predetermined operative position for engaging and thus sharpening the lower edge of a skate blade.

The sharpener includes guide structure for guidingly engaging a blade to be sharpened as the sharpener and blade are shifted relative to each other and the guide structure automatically compensates for skate blades of different thickness.

2. Description of Related Art

Various different forms of skate blade sharpeners including some of the general structural and operational features of the instant invention are disclosed in U.S. Pat. Nos. 555,974, 641,752, 1,273,624, 1,468,347, 2,154,744 and 2,542,281. However, these previously known forms of skate blade sharpeners do not include the overall combination of structual features of the instant invention which particularly well adapts the sharpener for manual sharpening of skate blades in a manner maintaining the skate blade being sharpened in precisely the correct position relative to the abrasive element of the sharpener being utilized to sharpen the blade.

SUMMARY OF THE INVENTION

The sharpener of the instant invention includes a body defining a wide, shallow and open ended slot and further defining a central depressed recess intermediate the opposite ends of the slot and spaced between the opposite sides thereof. A support for course and fine abrasive elements is mounted within the recess for shifting between first and second predetermined positions with the course and fine abrasive elements registered with and projecting slightly upwardly into the slot from therebeneath. In addition, opposing opposite side guide members are mounted from the body for movement toward and away from each other and include opposing pairs of rollers supported therefrom for rolling guiding engagement with opposite side surfaces of a skate blade disposed between the guide members, the guide members being yieldingly biased toward each other.

One of the opposite end portions of the bottom of the slot between which the recess is disposed guidingly engages the surface of the skate blade being sharpened and the rollers journalled from the guide members engage the opposite side faces of the skate blade, thereby enabling the sharpener to be maintained in precisely the correct position relative to the skate blade being sharpened as the sharpener and skate blade are shifted longitudinally relative to each other during the skate blade sharpening process.

The main object of this invention is to provide a skate blade sharpener which may be quickly utilized to sharpen a skate blade, even when the associated skate is being worn by the person using the skate blade sharpener.

Another object of this invention is to provide a skate blade sharpener including features thereof which function to maintain the sharpener in correct positional orientation relative to a skate blade being sharpened throughout the blade sharpening process.

Another very important object of this invention is to provide a skate blade sharpener constructed in a manner whereby the skate edge sharpening abrasive elements thereof may be readily changed in order to renew the same or to substitute abrasive elements incorporating a different radius of curvature.

Yet another object of this invention is to provide a skate blade sharpener constructed in a manner whereby course and fine abrasive elements may be quickly alternately shifted between operative and inoperative positions.

A final object of this invention to be specifically enumerated herein is to provide a skate blade sharpener in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully described and claimed, reference being had to the accompanying drawings forming a part hereof, wherein like numerals refer to like parts throughout.

DESCRIPTION OF THE PREFERRED EMBODIMENT

Figure 1:
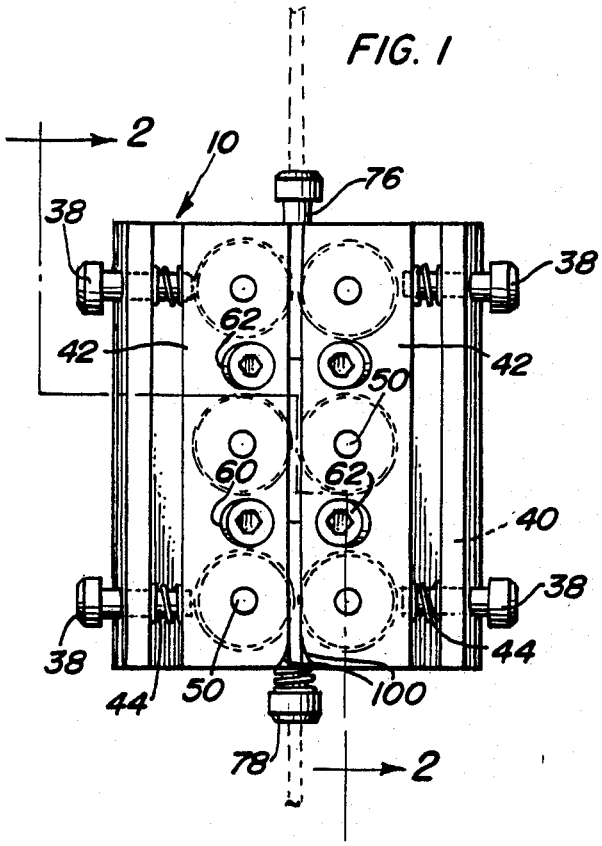
FIG. 1 is a top plan view of the skate blade sharpener with the guide members thereof in slightly spaced apart relation for receiving a skate blade to be sharpened therebetween, portions of an attendant skate blade being illustrated in phantom lines.

Referring now more specifically to the drawings, the numeral 10 generally designates the skate blade sharpener of the instant invention. The sharpener 10 includes a body 12 which is approximately two-thirds cylindrical in configuration and defines an upwardly facing flat side 14 extending along a chord of the body 12. The body 12 includes a longitudinally extending wide and shallow slot 16 formed therein between opposite side margins or marginal portions 18 and 20 of the body 12 and the slot 16 opens laterally outwardly through the flat side 14 and endwise outwardly of the opposite ends of the body 12.

The longitudinal mid-portion of the body 12 includes a recess 22 which is depressed relative to the bottom 24 of the slot 16 and opens upwardly through the surface defining the bottom 24 of the slot 16. The recess is generally U-shaped in cross-section and the body includes opposite end longitudinally aligned bores 26 and 28 formed therein which are generally centered relative to the recess 22. Accordingly, the inner ends of the bores 26 and 28 open into the recess 22. Further, the end of the bore 28 remote from the bore 26 includes a counter bore 30 for a purpose to be hereinafter more fully set forth. In addition, the side of the body 12 remote from the flat side 14 includes a longitudinal slot 32 formed therein which opens endwise outwardly of the opposite ends of the body 12 and has an abrasive element 34 supported from one side wall of the slot 32 and opposing the opposite side wall of the slot 32, the slot 32 opening in a direction opposite to the direction in which the slot 16 opens.

Each of the marginal portions 18 and 20 includes a pair of longitudinally spaced transverse bores 36 formed therein and each pair of bores slidingly receives the shank of a headed bolt 38 therethrough. The heads of the bolts are disposed outward of the marginal portions 18 and 20 and the shanks of the bolts project through the bores 36 and are removably threadingly seated in axially short threaded blind bores 40 formed in and spaced longitudinally along the near side of a corresponding elongated guide member 42 slidable over the bottom surface 24, compression springs 44 being disposed about the bolts 38 between the guide members 42 and the corresponding marginal portions 18 and 20. Accordingly, the guide members 42 are guidingly supported from the body 12 for movement toward and away from each other and are yieldingly biased toward each other.

In addition, the underside of each guide member 42 has three longitudinally spaced cylindrical recesses 48 formed therein and three shanks 50 project centrally into the recesses 48 through bores 52 formed in the guide members 42 from the upper sides thereof and opening centrally into the recesses 48. Three rollers 54 are journalled on each set of three shanks 50 within the corresponding recesses 48 and each set of recesses 48 opens slightly outwardly of the inner side of the corresponding guide member 42 through a window 56, see FIG. 2, through which the corresponding roller 54 ever so slightly projects.

Figure 2:
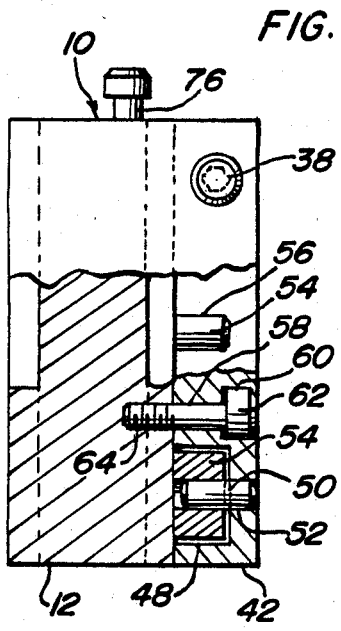
FIG. 2 is a sectional view taken substantially upon the plane indicated by the section line 2—2 of FIG. 1.

Also, with attention invited more specifically to FIGS. 1 and 2, each guide member includes a pair of vertical bores 58 formed therethrough including upper counter bores 60 and a pair of headed bolts 62 have their heads disposed in the counter bores 60 and their shanks 62 passing through the bores 58 and threadingly seated in threaded blind bores 64 formed in the body 12, the counter bores 60 being slightly elongated or oval transversely of the guide members 42. Accordingly, and with the heads 62 not quite fully seated in the counter bores 60, the guide members 42 are mounted for close tolerance guided movement toward and away from each other relative to the body 12.

Figure 3:
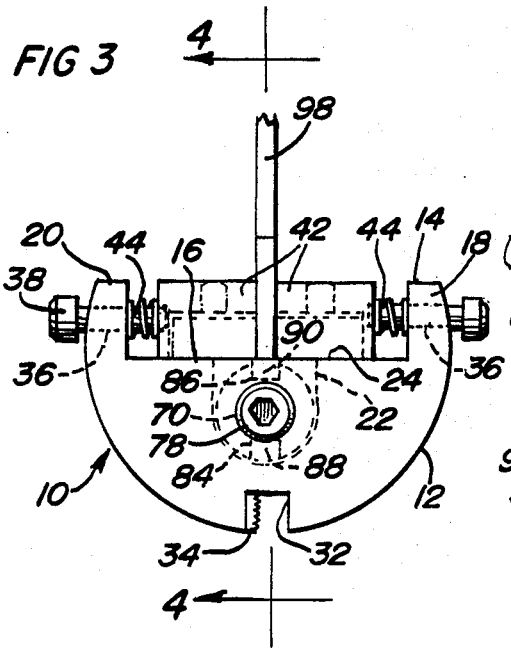
FIG. 3 is an end elevational view of the skate blade sharpener with an associated skate blade being fragmentarily illustrated in operative association with the sharpener.

The recess 22 includes a cylindrical body 70 removably received therein. The body 70 includes a longitudinal through bore 72 having threaded opposite end portions 74, see FIG. 4, and a pair of headed bolts 76 and 78 have their shank portions rotatably and slidably received through the bores 26 and 28 and include diametrically reduced threaded end portions 80 and 82 threaded in the opposite ends 74 of the bore 72. The body 70 includes diametrically opposite outer peripheral slots 84 and 86 formed therein in which abrasive elements 88 and 90, see FIG. 3, are secured. The abrasive elements 88 and 90 project slightly from the outer periphery of the cylindrical body 70 and are coated with course and fine abrasive materials, respectively, such as a diamond electroplated coating which is longitudinally straight and transversely convex. In addition, the abrasive element 34 includes a similar flat diamond electroplated surface opposing the surface 32.

Figure 4:
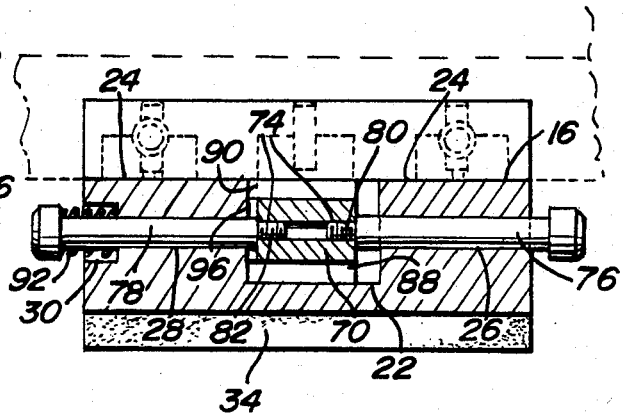
FIG. 4 is a vertical sectional view taken substantially upon the plane indicated by the section line 4—4 of FIG. 3 and with the attendant skate blade being fragmentarily illustrated in phantom lines.

A compression spring 92 is disposed in the counter bore 30 inwardly of the head of the bolt 78, see FIG. 4, and yieldingly biases the assembly comprising the body 70 and the bolts 76 and 78 toward the left limit position thereof illustrated in FIG. 4 with the left-hand projecting ends of the elements 88 and 90 seated in a diametric slot 96 formed in the left end wall of the recess 22, thereby keying the body 70 in a first predetermined position with the element 90 facing upwardly for engagement by the underside of a skate blade 98 disposed between the guide members 42. Additionally, the bolt 78 may be pushed inwardly toward the right as viewed in FIG. 4 of the drawings and turned 180° and thereafter released in order to key the body 70 in a 180° rotated position with the element 88 facing upwardly for engagement by the lower edge of the skate blade 98.

In operation, the guide members 42, which include rounded corners 100, see FIG. 1, may have the skate blade 98 to be sharpened introduced therebetween at the rounded corners 100 with the lower edge of the skate blade 98 engaged with the bottom surface 24 of the slot 16 and the elongated blade 98 and sharpener 110 may be shifted longitudinally relative to each other, whereby the lower edge of the blade 98 will be caused to move over the course abrasive element 88 when the latter is disposed in the uppermost position facing upwardly into the slot 96. After the lower edge of the blade 98 has been moved back and forth relative to the course abrasive element 88 in contact therewith sufficient to restore the lower edge of the blade 98 to its proper transverse contour, the body 70 may be rotated 180° to bring the fine abrasive element 90 into position for engaging the lower edge of the blade 98. Thereafter, a few longitudinal strokes of the blade 98 relative to the sharpener 10 will be sufficient to complete the sharpening operation. After the sharpening operation has been completed, the blade is inserted into the slot 32 and the opposite side edges thereof adjacent the bottom edge of the blade 98 are brought into contact with the abrasive element 34 in order to remove burrs which may have been formed during the initial sharpening process.

Inasmuch as the bolts 76 and 78 are threadedly engaged with the body 70, it may be readily appreciated that the body 78 may be removed and replaced by a similar body containing new abrasive elements corresponding to the elements 88 and 90 after the latter have been worn to the extent that they are no longer effective in sharpening a skate blade. In addition, a substitute body corresponding to the body 70 may be utilized a different radius of curvature on the abrasive elements thereof if a different radius of curvature is to be applied to the lower edge of a skate blade to be sharpened. Further, a one-piece shaft may be used in lieu of the two bolts 76 and 78 and the body 70 may be releasably anchored in position on such one-piece shaft by a diametric roll pin or a radial set screw. Also, the bores 64 may be lengthened to allow the bolts 62 to clamp guide members 42 in position immediately after engaging a skate blade therebetween and before the actual sharpening process begins and bolts may further be applied through the body 12 from therebeneath.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A skate blade sharpener including elongated horizontal body means having opposite ends and opposite side longitudinal margins between which an upwardly opening elongated slot is defined extending longitudinally of the body means and opening endwise outwardly of the ends of said body means, said body means including a central upwardly opening recess portion depressed below and opening upwardly into said slot intermediate the ends of said slot, a rotary member mounted in said recessed portion for adjusted angular displacement therein, about a horizontal axis paralleling said slot and body, between predetermined relatively angularly displaced positions with first and second peripheral portions registered with and facing upwardly through said slot, said rotary member peripheral portions including first and second radially outwardly facing abrasive elements supported therefrom projecting outward of said recess portion and slightly into said slot, laterally spaced opposite side guide members mounted from said body means margins on opposite sides of a vertical plane containing said axis and slot for independent sliding guided movement relative to said body means along a straight path generally normal to said plane toward and away from each other and said plane above said axis and including opposing guide surfaces for engaging and guiding the side surfaces of a skate blade positioned with its medial plane coinciding with the first mentioned plane and having a lower edge engaged with the uppermost abrasive element, means independently yieldingly biasing said guide members toward said first mentioned plane.

2. The sharpener of claim 1 wherein one of said elements comprises a course abrasive element and the other element comprises a fine abrasive element.

3. The sharpener of claim 1 wherein said guide surfaces include opposing peripheral portions of a pair of rollers journalled from each of said guide members for rotation about axes paralleling said plane and spaced apart longitudinally of said body means.

4. A skate sharpener, said sharpener including elongated body means and elongated longitudinally straight and transversely convexly curved abrasive surface means extending longitudinally of said body means and facing laterally outwardly of said body means in one direction along a predetermined path, a pair of guide members independently shiftably mounted from said body means on opposite sides of a plane containing said path and said elongated abrasive surface means for independent sliding guided movement relative to said body means along a straight path generally normal to said plane toward and away from said plane and including guide surfaces generally paralleling and opposing said plane for engaging and guiding the side surfaces of a skate blade disposed in said plane and having an ice engageable edge engaged with said abrasive surface means, and means independently yieldingly biasing said guide members, relative to said body means, toward said plane.

5. The sharpener of claim 4 wherein said guide surfaces include opposing peripheral portions of a pair of rollers journalled from each of said guide members for rotation about axes generally paralleling said plane and said one direction and spaced apart longitudinally of said body means.

6. The sharpener of claim 4 wherein said body means includes means defining an elongated slot extending longitudinally of said body means, opening endwise outwardly of the opposite ends of said body means and opening laterally outwardly of said body means in a direction coinciding with said medial plane, said slot including bottom surfaces substantially normal to said plane, disposed outwardly of the opposite ends of said abrasive surface means and above which said abrasive surface means projects only slightly.

7. The sharpener of claim 6 wherein said abrasive surface means includes a support mounted from said body for shifting relative thereto between first and second predetermined positions, said support including a first and second elongated abrasive element supported therefrom and which face laterally outwardly of said body means along said predetermined path when said support is in said first and second predetermined positions, respectively.

8. The sharpener of claim 7 wherein said first element comprises a course abrasive element and said second element comprises a fine abrasive element.

* * * * *